US005361424A

United States Patent [19]

Grünenfelder et al.

[11] Patent Number: 5,361,424

[45] Date of Patent: Nov. 8, 1994

[54] SPREADABLE PROTECTIVE COVER FOR TOILET SEATS

[75] Inventors: Daniel Grünenfelder, Jurastrasse 15, CH-2544 Bettlach; Ulrich Rindlisbacher, Seftigen, both of Switzerland

[73] Assignee: Daniel Grünenfelder, Bettlach, Switzerland

[21] Appl. No.: 105,624

[22] Filed: Aug. 13, 1993

[30] Foreign Application Priority Data

Oct. 27, 1992 [CH] Switzerland ..... 03 341/92-7

[51] Int. Cl.[5] ..... A47K 13/14

[52] U.S. Cl. ..... 4/245.1; 4/245.8; 4/245.4

[58] Field of Search ..... 4/245.1–245.9

[56] References Cited

U.S. PATENT DOCUMENTS

| | | | |
|---|---|---|---|
| 1,591,014 | 7/1926 | Cambell | 4/245.8 |
| 1,761,391 | 6/1930 | Harris | 4/245.3 |
| 4,875,242 | 10/1989 | Albrect et al. | 4/243 |
| 4,887,321 | 12/1989 | MacLean | 4/245.5 |
| 5,144,698 | 9/1992 | McKenzie | 4/245.2 |

FOREIGN PATENT DOCUMENTS

| | | | |
|---|---|---|---|
| 0097133 | 12/1983 | European Pat. Off. . | |
| 0331631 | 9/1989 | European Pat. Off. . | |
| 2625669 | 7/1989 | France | 4/245.4 |
| 2631806 | 12/1989 | France | 4/245.5 |
| 3251219 | 11/1991 | Japan | 4/245.8 |
| 674795 | 7/1990 | Switzerland . | |

*Primary Examiner*—Henry J. Recla
*Assistant Examiner*—Gregory M. Vidovich
*Attorney, Agent, or Firm*—Brady, O'Boyle & Gates

[57] ABSTRACT

A spreadable protective cover for toilet seats exhibits at least one spreadable segmented web (1, 2) glued together from many substantially identical single leaves. Two segmented webs (1, 2) are preferably provided wherein one of the two encompasses the toilet seat from the outside. In the folded condition, the protective cover has, for example, a U-shaped cut-out pattern.

10 Claims, 2 Drawing Sheets

SPREADABLE PROTECTIVE COVER FOR TOILET SEATS

STATE OF THE ART

A spreadable protective cover for toilet seats has been known, for example, from Swiss 674,795 A5. This reference involves a paper web folded accordion-style which can be placed on the seat rim by the user after he has pulled it apart.

It is important for the acceptance of such a hygienic article that it can be attached to the seat rim with a few manipulations and without having to touch the toilet seat proper. Furthermore, the product should be inexpensive, requiring an efficient manufacturing method. The conventional toilet seat covers cannot satisfy these needs comprehensively.

DESCRIPTION OF THE INVENTION

It is, therefore, an object of the invention to offer a spreadable protective cover for toilet seats which can be economically manufactured in a practical way and in large quantities.

A protective cover according to this invention is distinguished by at least one spreadable segmented web made by gluing together many substantially identical individual leaves.

Thereby a design creativity is obtained which is considerably improved as compared with the folded products. The glue dissolves in water and permits waste disposal of the segmented web, broken up into individual sections, without any problems.

The segmented web represents the hygienic seating surface. Preferably two and, if needed, even three segmented webs can be provided. The second and third segmented strips come to lie on the outside and, respectively, inside at the seat rim and take care that the protective cover in its entirety will not slip off the seat rim readily. As will be revealed below, however, there are also other possibilities for affixing the protective cover to the toilet seat.

The individual leaves preferably exhibit a hook-shaped cut-out form so that the spread-out protective cover will extend around the toilet seat at least in part also from the outside. The segmented web has a certain, though limited, elasticity in the spreading direction (i.e. perpendicularly to the individual segments). The protective cover of this invention thus has the tendency to contract. If the cover is placed about a round toilet seat rim, encompassing the latter partially from the outside, it will automatically hug the round configuration.

The individual leaves are preferably glued together along at least three glue lines so that the segmented web has a honeycomb-like structure in lateral view when expanded. The honeycomb structure contributes in a not insubstantial way toward the aforedescribed elasticity. Furthermore, the greater number of glued panels raises the stability of the spread-out protective cover.

A protective cover is especially preferred having two joined-together segmented webs, one serving for covering the seating surface of the toilet seat and the other for covering the outer rim. Such a protective cover can be applied to the toilet seat in a simple way and also is seated reliably. By virtue of the inherent elasticity of the segmented web with the result that the protective cover hugs the seat rim from the outside, there is no need to provide a protective cover section extending into the ring-shaped seat, and no need for its manipulation. Subjectively, of course, any manipulation to be performed on the inside of the toilet seat ring is unpleasant.

The protective cover of this invention consists typically of paper. In order to render the segmented web serving as the seating surface more comfortable and offer a greater degree of safety to the user, at least three glue lines can be provided per individual segment, so that the segmented web, when spread out, forms an at least two-ply layer of material.

The individual leaves preferably exhibit a U-shaped cut-out configuration, each leg having at least two glue lines. Each leg forms one segmented strip upon spreading. Due to the fact that the connecting bridge between the two legs is relatively narrow, the two segmented strips can open up in a V shape after spreading.

With a view toward low consumption of material, it is advantageous to fashion the legs of the U-shaped cutting pattern to be of different lengths.

Advantageously, an oblique cut is provided on the outside of the bridge connecting the legs. When such protective covers are stored in collapsed form in a package, then the oblique cut permits an easy withdrawal of an individual protective cover.

In order to place the protective cover firmly upon the toilet seat rim, the cut-out form can have a projection designed and arranged in such a way that it engages hook-like at the seat rim, in the spread-apart condition of the protective cover, from below.

Preferably, self-sticking areas are arranged at both ends of the segmented web to affix the spread-out protective cover to the toilet seat.

Additional advantageous embodiments and combinations of features can be seen from the detailed description and the entirety of the claims.

BRIEF DESCRIPTION OF THE DRAWINGS

The invention will be described in greater detail below with reference to embodiments and in conjunction with the drawings wherein.

Basically, corresponding items in the figures bear identical reference symbols.

WAYS OF EXECUTING THE INVENTION

Figure 1:
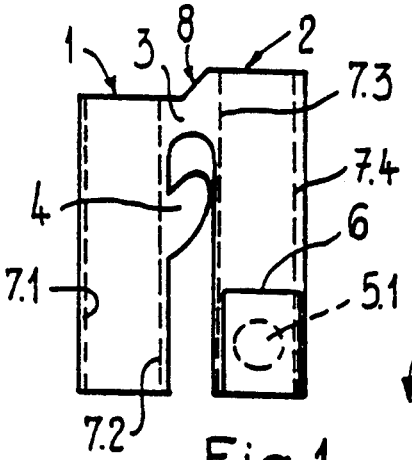
FIG. 1 shows a lateral view of a folded protective cover according to this invention.

FIG. 1 shows a first preferred embodiment of the invention. The protective cover is shown from the broadside. It comprises two segmented webs 1, 2 joined via an intermediate bridge 3. The two segmented webs 1, 2 form, in the collapsed condition of the protective cover, two legs of a U-shaped cutting pattern. The two legs have a width of about 2 to 2.5 cm. The intermediate bridge 3 is rather narrow (for example 1 cm at the narrowest point).

A projection 4 is formed on the inside of the leg forming one of the segmented webs; this projection can engage a toilet seat rim in the manner of a barb.

Figure 2:
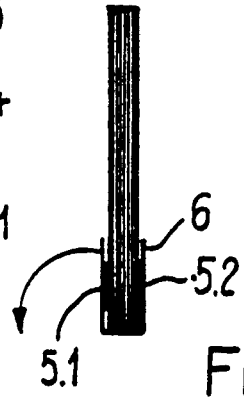
FIG. 2 shows a view of the narrow side of the protective cover according to FIG. 1.
Figure 3:
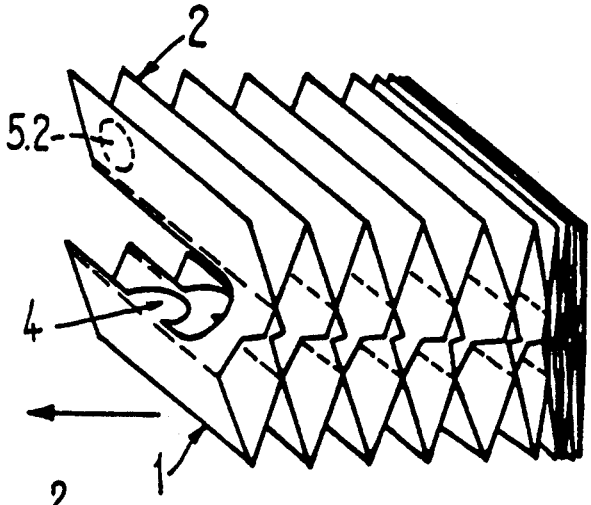
FIG. 3 is a perspective illustration of a slightly opened protective cover.
Figure 4:
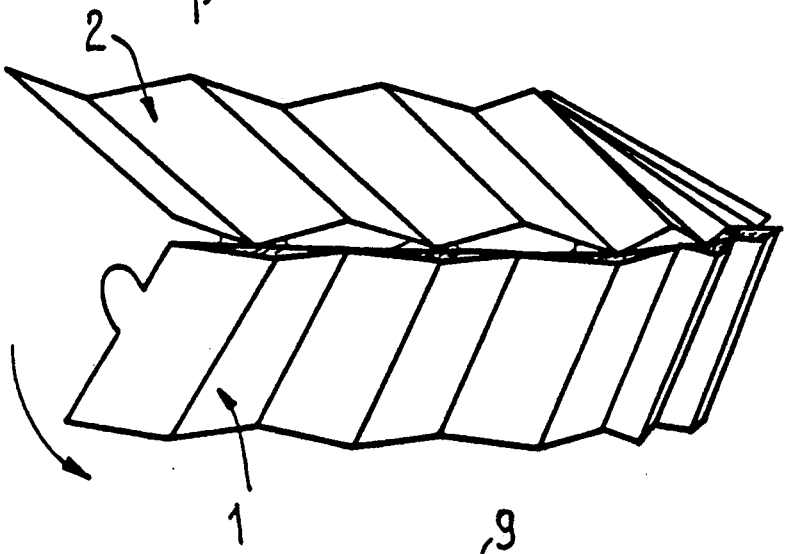
FIG. 4 shows a perspective view of the spread-out protective cover.
Figure 5:
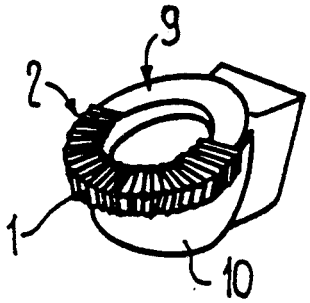
FIG. 5 shows a toilet seat covered with the protective cover of this invention.

At the free end of the other leg, an adhesive 5.1, 5.2 (compare FIG. 2) is provided on the outermost single leaves, protected by a cover film 6 until use. The cover film prevents, at the same time, a spontaneous unfolding of the protective cover prior to usage. On the rear side (outer side) of the intermediate bridge 3, an oblique cut 8 is formed. The length of the two legs is slightly different in correspondence with the side of the oblique cut 8. Two glue lines 7.1, 7.2 and, respectively 7.3, 7.4 are provided per segmented web 1, 2. They form in each case the borderline for the longitudinal sides of the two legs. The protective cover of this invention is produced by means of the conventional vane technique.

Figure 10:
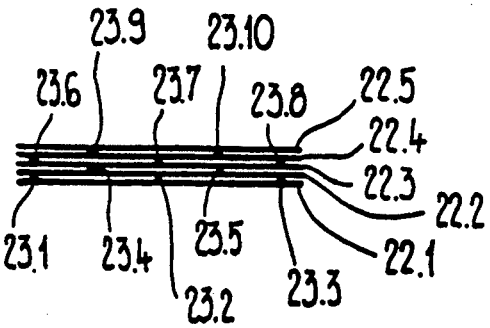
FIG. 10 shows a schematic view of the arrangement of the glue seams in a protective cover according to this invention.

This is shown by way of example in FIG. 10. For the sake of simplicity, only five individual leaves 22.1, . . . 22.5 are illustrated in FIG. 10. Of course, under practical conditions, these leaves comprise 20–200, especially 40–80 pieces in correspondence with the desired length of the spread seat cover (of, for example, 1 m) and the spacing of the glue lines (e.g., 1–3 cm). The individual segments 22.1, . . . 22.5 are joined together along mutually offset, parallel glue seams 23.1, . . . 23.10. In the present example, the glue seams 23.1, . . . 23.10 are arranged in five glue lines, wherein respectively two glue seams 23.1, 23.6, respectively 23.4, 23.9, respectively 23.2, 23.7, respectively 23.5, 23.10, respectively 23.3, 23.8 lie on the same glue line. Those glue seams 23.1, 23.2, 23.3 connecting the two first individual segments 22.1, 22.2 are all located on other glue lines different from those glue seams 23.4, 23.5 which connect the two subsequent individual segments 22.2, 22.3. The glue seams in two successive intermediate planes thus are always mutually offset. This should suffice to explain the vane technique.

With reference to FIGS. 2–5, the following description is to explain the functioning of the protective cover of this invention. First of all, the cover film 6 is removed from the adhesive areas 5.1, 5.2 (see arrow in FIG. 2). The protective cover can now be spread out. For this purpose, the cover is grasped at the outermost single segments which are also provided with the adhesive 5.1, 5.2 and is pulled apart (arrow in FIG. 3). On account of the expansion, the protective cover shows a honeycomb-like structure when viewed from the narrow side. Once the protective cover has been pulled open, the two segmented webs 1, 2 can unfold in a V-shape (compare arrow in FIG. 4). This is so because the intermediate bridge 3 becomes flexible in the elongated condition. Now the protective cover can be placed on the toilet seat 9 of the toilet bowl 10, the segmented web 2 serving as the seating surface and the segmented web 1 encompassing the toilet seat from the outside. The projections 4 of the individual segments engage hook-like under the seat rim and thereby improve the retention of the protective cover. By means of the two adhesive areas 5.1, 5.2, the protective cover is glued to the toilet seat 9. The protective cover thus can be fastened from above without having to touch the toilet seat proper.

Figure 6:
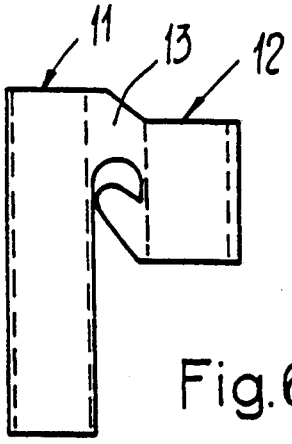
FIG. 6 shows a protective cover with two dissimilar segmented webs.

FIG. 6 shows a second embodiment distinguished by a reduction in paper required. The protective cover of FIG. 6 differs in the cut-out configuration from that according to FIG. 1 simply in that one leg (segmented web 12) is only about half as long as the other (segmented web 11). The intermediate bridge 13 can be fashioned in the same way as that of FIG. 1.

Figure 7:
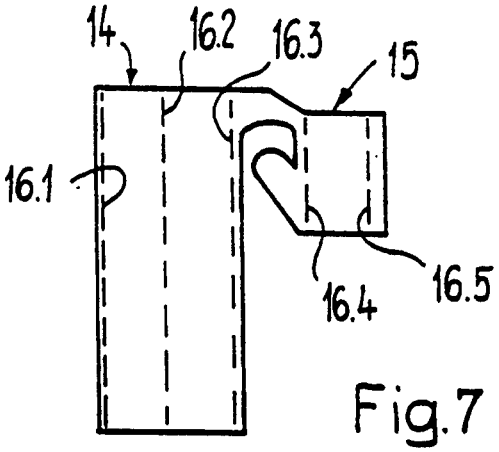
FIG. 7 shows a protective cover with a double-ply segmented web.

FIG. 7 shows a more comfortable embodiment wherein the segmented web 14 used as the seating surface forms, in the spread-out condition, a two-ply layer of material. In order to attain this objective, the corresponding leg of the cut-out shape exhibits three glue lines 16.1, 16.2, 16.3 instead of only two. The other leg exhibits only two glue lines 16.4, 16.5, i.e. the segmented web 15 forms only one layer of material. The intermediate bridge 13 is designed as described above, i.e. without a glue line of its own.

The embodiments according to FIGS. 6 and 7 are spread out and fastened in the same way as that of FIG. 1. The width of the segmented web 12 and 15, respectively, encompassing the toilet seat from the outside (corresponding to the length of the leg of the cutout form) is simply somewhat smaller than in the first embodiment.

Figure 8:
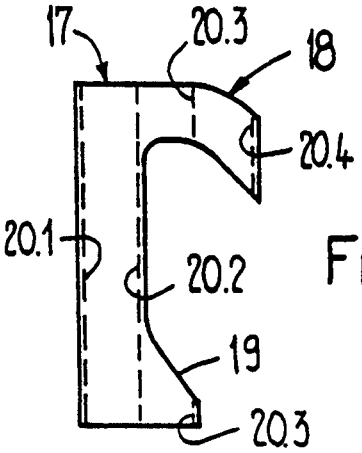
FIG. 8 shows a protective cover with only one segmented web.

FIG. 8 shows a protective cover having, in principle, only one segmented web 17. The cut-out configuration is L-shaped in a certain sense. A hook-shaped extension 18 is formed at one end of the leg constituting the segmented web 17. An extension 19 is formed at the other end. The cut-out shape comprises four glue lines 20.1, . . . 20.4. The first two glue lines 20.1, 20.2 form a border for the leg constituting the segmented web 17. The hook-shaped extension 18 proper has two glue lines 20.3, 20.4. The glue line 20.3 furthermore terminates the outer end of the extension 19.

In contrast to the embodiments according to FIGS. 1–7, there is no segmented web which can be folded down and can encompass the toilet seat from the outside. This function is performed by the extension 18. The extension 19 comes to lie against the toilet seat on the inside and improves the retention of the protective cover.

Figure 9:
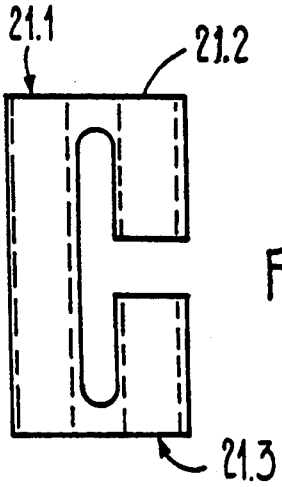
FIG. 9 shows a protective cover with three segmented webs.

FIG. 9 finally shows an embodiment with three segmented webs 21.1, 21.2, 21.3. This embodiment has a C-shaped cutting pattern. The segmented webs 21.2 and 21.3 can be unfolded, during spreading apart, in a way anologous to the first embodiment and encompass the toilet seat from the inside and, respectively, from the outside.

Protective covers according to this invention can be manufactured on a large scale and in economical fashion. In this process, conventional and well-proven techniques can be utilized. If the cutting pattern is suitably chosen, the protective covers can be punched out in a manner which saves paper. Along these lines, cutting patterns are suitable, in particular, which can be combined in each case to form a congruent pattern (compare, for example, FIG. 6). Normally, glue lines with regular spacings are advantageous in this connection.

In place of a continuously extending cover sheet pulled over the "edge", it is also possible to provide two individual disks with grasping ears. It is understood that the oblique cut does not represent an absolutely necessary feature of the invention. In particular, ready removability from a package can also be obtained in some other way (for example as in the case of facial tissue).

The entire protective cover consists preferably of biodegradable, nonpolluting materials. In particular, the protective cover should be readily dissolvable in water. Paper grades and adhesives satisfying these requirements are known per se.

In summation, it can be stated that the invention has created a novel kind of spreadable protective covers which are convenient and handy and can be designed in variegated ways. Consequently, the invention is markedly distinguished over the heretofore known products based solely on folded paper.

We claim:

1. A spreadable protective cover for toilet seats comprising, a plurality of substantially identical individual sheets, each sheet having first and second leg portions connected by an intermediate bridge portion, at least one of said leg portions having a length approximately equal to the width of a toilet seat, said plurality of identical sheets overlying each other and being glued along glue seams that are arranged along a plurality of substantially parallel glue lines extending parallel to said leg portions thereby forming honeycomb-like segmented webs when said sheets are spread open in a direction normal to said leg portions, and wherein said plurality of sheets are of sufficient amount such that when said sheets are spread open to form said segmented webs, said web formed by said one of said leg portions will adequately cover a top surface of a toilet seat.

2. A spreadable protective cover according to claim 1, in which said plurality of substantially parallel glue lines comprise at least three substantially parallel glue lines.

3. A spreadable protective cover according to claim 1, in which the individual sheets each have a hook-like cut-out form adapted to encompass, at least in part, an outer side of the toilet seat when said protective cover is spread open.

4. A spreadable protective cover according to claim 1, in which two honeycomb-like segmented webs are formed when said sheets are spread open joined together by said intermediate bridge portions, one segmented web serving for covering the top surface of the toilet seat and the other segmented web serving for covering the outer rim of the toilet seat.

5. A spreadable protective cover according to claim 1, in which said segmented web formed to cover the top surface of the toilet seat includes on each individual sheet, at least three of said substantially parallel glue lines, said glue seams in two successive intermediate planes being mutually offset so that the segmented web forms, when spread open, an at least two-ply honeycomb-like layer of material.

6. A spreadable protective cover according to claim 1, in which said individual sheets are U-shaped, and each of said first and second leg portions has at least two of said substantially parallel glue lines.

7. A spreadable protective cover according to claim 1, in which said first and second leg portions have differing lengths.

8. A spreadable protective cover according to claim 1, in which said intermediate bridge portion connecting said first and second leg portions has an outside oblique cut edge.

9. A spreadable protective cover according to claim 1, in which said individual sheets of said segmented web formed to cover a top surface of a toilet seat having a cut-out pattern with a projection for hooking the cover to the rim of the toilet seat from below in the spread open condition of the protective cover.

10. A spreadable protective cover according to claim 1, in which said segmented web has two ends with self-sticking areas for adhesively securing said cover on the toilet seat.

* * * * *